US009597554B2

(12) United States Patent
Thurman et al.

(10) Patent No.: US 9,597,554 B2
(45) Date of Patent: Mar. 21, 2017

(54) RACQUET HIT NOTIFICATION

(71) Applicant: WILSON SPORTING GOODS CO., Chicago, IL (US)

(72) Inventors: Robert T. Thurman, Plainfield, IL (US); William D. Severa, Darien (IL)

(73) Assignee: Wilson Sporting Goods Co., Chicago, IL (US)

( * ) Notice: Subject to any disclaimer, the term of this patent is extended or adjusted under 35 U.S.C. 154(b) by 97 days.

(21) Appl. No.: 14/453,837

(22) Filed: Aug. 7, 2014

(65) Prior Publication Data

US 2015/0045153 A1 Feb. 12, 2015

Related U.S. Application Data

(60) Provisional application No. 61/863,178, filed on Aug. 7, 2013.

(51) Int. Cl.

| | |
|---|---|
| ***A63B 49/00*** | (2015.01) |
| ***A63B 49/02*** | (2015.01) |
| ***A63B 69/38*** | (2006.01) |
| ***A63B 24/00*** | (2006.01) |
| *A63B 71/06* | (2006.01) |

(52) U.S. Cl.

CPC ..... *A63B 49/00* (2013.01); *A63B 24/0062* (2013.01); *A63B 69/38* (2013.01); *A63B 2071/063* (2013.01); *A63B 2071/0625* (2013.01); *A63B 2071/0658* (2013.01); *A63B 2220/17* (2013.01); *A63B 2220/40* (2013.01); *A63B 2220/53* (2013.01); *A63B 2220/833* (2013.01); *A63B 2225/50* (2013.01)

(58) Field of Classification Search

CPC ..... A63B 24/00; A63B 49/00; A63B 51/00; A63B 51/005; A63B 59/00; A63B 69/00; A63B 69/38; A63B 71/06; A63B 71/0619; A63B 71/0622; A63B 71/0625; A63B 71/0694; A63B 2220/50; A63B 2220/51; A63B 2220/53; A63B 24/0062; A63B 2220/17; A63B 2220/40; A63B 2220/833; A63B 2225/50; A63B 2071/0625; A63B 2071/063; A63B 2071/0658

USPC ..... 473/461, 553

See application file for complete search history.

(56) References Cited

U.S. PATENT DOCUMENTS

| | | | | |
|---|---|---|---|---|
| 3,897,058 | A | 7/1975 | Koch | |
| 4,759,219 | A | 7/1988 | Cobb et al. | |
| 4,822,042 | A * | 4/1989 | Landsman | A63B 69/38 340/323 R |
| 4,870,868 | A | 10/1989 | Gastgeb et al. | |
| 4,911,441 | A * | 3/1990 | Brunner | A63B 69/3632 473/202 |
| 4,967,596 | A | 11/1990 | Rilling et al. | |
| 5,031,909 | A | 7/1991 | Pecker | |
| 5,372,365 | A | 12/1994 | Mcteigue et al. | |
| 5,646,911 | A * | 7/1997 | Davis | A63B 71/0622 368/10 |
| 5,841,029 | A | 11/1998 | Luking | |

(Continued)

*Primary Examiner* — Raleigh W Chiu

(74) *Attorney, Agent, or Firm* — Terence P. O'Brien; Todd A. Rathe

(57) ABSTRACT

An apparatus for use with a sports racquet. The apparatus including a sensor to be carried by the racquet and an indicator in communication with the sensor to output a notification based on the number of hits by the racquet based on signals from the sensor.

16 Claims, 5 Drawing Sheets

(56) References Cited

U.S. PATENT DOCUMENTS 6,134,965 A * 10/2000 Somville ..... A63B 49/00 473/461
6,173,610 B1 1/2001 Pace
D458,171 S * 6/2002 Lin ..... D10/97
6,409,616 B1 * 6/2002 Lin ..... A63B 69/38 473/463
6,527,655 B2 3/2003 Sims et al.
7,021,140 B2 4/2006 Perkins
7,104,905 B2 9/2006 Schwenger et al.
7,108,617 B2 9/2006 Gorski et al.
7,140,248 B1 11/2006 Brundage
7,234,351 B2 6/2007 Perkins
7,326,133 B1 * 2/2008 Choi ..... A63B 24/0021 473/553
8,449,410 B1 5/2013 Kaufman
8,602,922 B2 12/2013 Schwenger et al.
8,903,521 B2 12/2014 Goree et al.
8,905,855 B2 12/2014 Fitzpatrick et al.
8,941,723 B2 1/2015 Bentley et al.
8,944,928 B2 2/2015 Kaps et al.
2002/0007676 A1 1/2002 Ward et al.
2002/0068652 A1 * 6/2002 Sims ..... A63B 71/0669 473/524
2002/0134153 A1 9/2002 Grenlund
2005/0192129 A1 9/2005 Kuwabara
2005/0197198 A1 9/2005 Otten et al.
2005/0261073 A1 11/2005 Farrington, Jr. et al.
2007/0105664 A1 * 5/2007 Scheinert ..... A63B 49/00 473/461
2008/0163697 A1 7/2008 Silpachai et al.
2008/0200287 A1 8/2008 Marty et al.
2010/0279800 A1 11/2010 Zuger
2011/0183787 A1 * 7/2011 Schwenger ..... A63B 49/00 473/553
2012/0004055 A1 1/2012 Balasubramanyan
2012/0277890 A1 11/2012 Han
2012/0278023 A1 11/2012 Han
2013/0298668 A1 11/2013 Sato
2013/0316855 A1 11/2013 Mace
2013/0319113 A1 12/2013 Mizuta
2015/0045153 A1 * 2/2015 Thurman ..... A63B 69/38 473/553
2015/0057112 A1 * 2/2015 Sak ..... A63B 24/0003 473/461
2015/0141175 A1 * 5/2015 Pisupati ..... G06Q 10/0639 473/461
2015/0157901 A1 6/2015 Mace et al.

* cited by examiner

RACQUET HIT NOTIFICATION

RELATED U.S. APPLICATION DATA

The present application claims priority to U.S. Provisional Patent Application Ser. No. 61/863,178 filed on Aug. 7, 2013, which is hereby incorporated by reference in their entirety.

BACKGROUND

Many racquets, such as tennis racquets, utilize a taut string bed to provide a hitting surface. Over time, the tension of the stringing of the string bed declines, potentially negatively impacting performance. Determining when the stringing needs to be replaced or re-strung is difficult and subjective.

DETAILED DESCRIPTION OF THE EXAMPLE EMBODIMENTS

Figure 1:
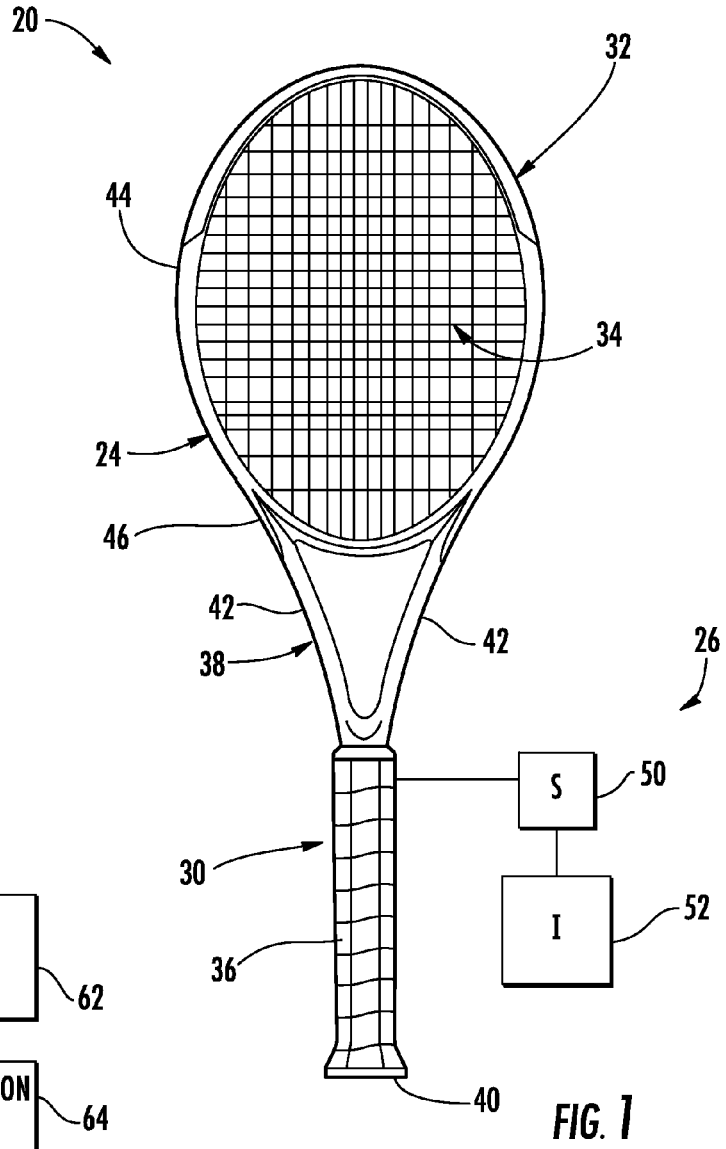
FIG. 1 is a schematic diagram of an example racquet system.

FIG. 1 illustrates an example a racquet system 20. As will be described hereafter, racquet system 20 senses ball impacts or hits against strings of a racquet 24 and outputs a notification based on a number of ball impacts with a stringing 34. System 20 comprises racquet 24 and hit notification system 26.

Racquet 24 comprises a racquet utilizing strings or stringing held in tension as a hitting surface. In the example illustrated, racquet 24 comprises a tennis racquet. In other implementations, racquet 24 may comprise other forms of racquets for use in other sports such as racquetball racquets, badminton racquets, squash racquets in other racquets that utilize stringing as a hitting surface. Racquet 24 includes a frame extending along a longitudinal axis and including a handle portion 30 (or shaft), a head portion 32, and a throat portion 38 coupling the head and handle portions 32 and 30. The frame is a tubular structure formed of a lightweight, durable material, preferably a carbon-fiber composite material.

As used herein, the term "fiber composite material" or "composite material" refers to a plurality of fibers impregnated (or permeated throughout) with a resin. The fibers can be co-axially aligned in sheets, layers or plies, or braided or weaved in sheets or layers, and/or chopped and randomly dispersed in one or more layers. A single ply typically includes hundreds or thousands of fiber bundles that are initially arranged to extend coaxially and parallel with each other through the resin that is initially uncured. Each of the fiber bundles includes a plurality of fibers. The fibers are formed of a high tensile strength material such as carbon. Alternatively, the fibers can be formed of other materials such as, for example, glass, graphite, boron, basalt, carrot, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers. In multiple layer or ply constructions, the fibers can be aligned in different directions with respect to the longitudinal axis 16, and/or in braids or weaves from layer to layer. Alternatively, the frame 12 can be formed of other materials including metallic alloys, other composite materials, wood, or combinations thereof.

Head portion 32 extends from throat portion 38 of handle portion 30 and holds or supports stringing 34. Head portion 32 is a tubular structure that includes inner and outer peripheral walls comprising a hoop 44 joined to throat portion 38 at shoulder 46. A proximal region of the hoop 44 includes a yoke. Hoop 44 supports stringing 34. Stringing 34 comprises a length of string secured to or threaded through openings (or string holes) in hoop 44.

Handle portion 30 extends from head portion 32 and comprises handle 36 and throat portion 38. The handle portion 30 includes a pallet (not shown), a grip 36 and a butt cap 40. In one implementation, the handle portion 30 can be a tubular structure formed by an extension of the first and second throat tubes 42 of the throat portion 38. In another implementation, the handle portion can be a tubular structure separate from either the throat portion or the head portion of the frame and attached to the throat portion through use of conventional fasteners, molding techniques, bonding techniques, adhesives or combinations thereof. Handle portion 30 terminates at butt cap 40 at one end and is joined to throat portion 38 at another end. Grip 36 provides a surface for being gripped by a person during use of racquet 24.

Throat portion 38 couples the head portion 32 to the handle portion 30. In the example illustrated, throat portion 38 comprises a pair of first and second throat tubes 42 (or diverging forks). In other implementations, throat portion 38 may comprise a single shaft or bar extending between handle 36 and head portion 32. In one implementation, the head portion 32 is directly connected to one or both of the throat portion 38 and the yoke through the use of conventional fasteners, adhesives, mechanical bonding, thermal bonding, or other combinations thereof. In another implementation, the head portion 32 can be separated from one or both of the throat portion and the yoke by a vibration and shock absorbing material, such as an elastomer. In yet another implementation, the head portion 32 can be integrally formed with one or both of the throat portion 38 and the yoke.

Racquet 24 is configured for supporting stringing 34. Stringing 34 is secured and maintained in a taut state under tension so as to provide a hitting face or hitting surface for a ball (such as a tennis ball) or other projectile. In one implementation, stringing 34 is formed by a plurality of main string segments, shown extending generally vertically on FIG. 1, alternately interwoven or interlaced with a plurality of cross string segments, shown extending generally horizontally on FIG. 1. Stringing 34 can be generally uniform with constant spacing between the string segments. In alternative implementations, stringing can have some spacing variability provided that the spacing of the main and cross string segments of the string bed is most dense at the center of the stringing (or near the geometric center of the string bed or string bed area). In other implementations, the main and/or cross string segments can be angled with respect to vertical and horizontal, respectively. The main and cross string segments can be formed from one continuous piece of racquet string, or from two or more pieces of racquet string. The racquet string is formed of a high tensile strength, flexible material. In example implementations, the racquet string can be formed of a polyester material, a nylon, a natural gut material and/or a synthetic gut material. The polyester materials used to make the racquet string can include polyether ether ketone (PEEK), polytetrafluoroethylene (PTFE), other polyester materials, and combinations thereof. The racquet string can be formed in a monofilament construction or in a multiple-filament construction.

Hit notification system 26 senses impacts or hits of the ball (such as a tennis ball) or other projectile against stringing 34 of racquet 24 and outputs a notification based on the number of hits or impacts by the racquet. Hit notification system 26 comprises sensor 50 and indicator 52. Sensor 50 comprises one or more sensing devices carried by racquet 24 and configured to sense impacts of a ball or other projectile against stringing 34. In one implementation, sensor 50 senses a sound created during impact of racquet 24 with a ball or projectile. In another implementation, sensor 50 senses a change in motion or acceleration of racquet 24 before, during and/or after impact of racquet 24 with a ball or projectile. In another implementation, sensor 50 senses vibration or forces occurring during impact of racquet 24 with a ball or projectile. In another implementation, the sensor can sense a load, a force and/or a deflection of the racquet 24 and/or the stringing 34 upon impact with a ball. In the example illustrated, sensor 50 comprises an accelerometer. In other implementations, sensor 50 may comprise other forms of sensors which produce signals facilitating the detection identification of the impact between stringing 34 and a ball or projectile. In one implementation, sensor 50 can be a vibro-acoustic sensor that combines aspects of an accelerometer and a microphone (or audio sensor). In other implementations, the sensor can be one or more strain gauges and/or load cells.

In one implementation, sensor 50 is incorporated into or embedded in an interior portion of racquet 24. For example, in one implementation, sensor 50 is embedded within a hollow interior of hoop 44. In another implementation, sensor 50 is embedded within a hollow interior of throat portion 38. In yet another implementation, sensor 50 is embedded within handle 36. In another implementation, the sensor 50 can be incorporated into the butt cap 40.

In another implementation, sensor 50 can be mounted, fastened or otherwise secured to an exterior portion of racquet 24. In one implementation, sensor 50 is removable mounted to racquet 24. In another implementation, sensor 50 is fixedly secured to racquet 24. For example, in one implementation, sensor 50 is mounted along an outside edge of hoop 44. In another implementation, the sensor is coupled to the butt cap 40. In another implementation, the sensor 50 is coupled to the handle 36. In another implementation, sensor 50 is mounted along an inside edge of hoop 44. In one implementation, sensor 50 is mounted so as to contact stringing 34. In another implementation, sensor 50 is mounted along an interior exterior side, edge or face of throat portion 38. For example, in one implementation, portions of racquet 24 may include a recess or cavity receiving sensor 50. In one implementation, sensor 50 is secured to racquet 24 during the manufacture of racquet 24. In another implementation, sensor 50 is secured to racquet 24 as an after-market accessory. In other implementations, sensor 50 can be a combination of one or more of the above-listed implementations.

Indicator 52 communicates with sensor 50 and outputs a notification based upon a number of hits or impacts between racquet 24 and a ball or projectile based upon signals from sensor 50. The notification provided by indicator 52 may comprise a sound, an illumination, one or more alphanumeric characters or symbols and the like. As will be described hereafter with respect to subsequent example implementations, indicator 52 may be entirely carried by racquet 24, may have portions that are carried by racquet 24 and portions that are remote from racquet 24 or maybe entirely remote from racquet 24.

Figure 1A:
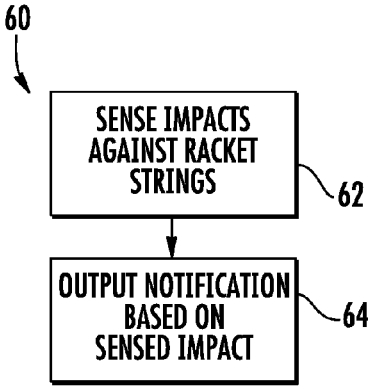
FIG. 1A is a flow diagram of an example method that may be carried out by the racquet system of FIG. 1.

FIG. 1A illustrates an example method 60 that may be carried out by racquet system 20 or other racquet systems described hereafter. As indicated by step 62, sensor 50 senses impacts against racquet strings or stringing 34. As indicated by step 64, indicator 52 outputs a notification based upon the sensed impacts against strings or stringing 34 of racquet 24. Overall, hit notification system 26 provides a notification based upon a number of hits or impacts between racquet 24 and a ball or projectile. This notification facilitates the determination of the wear or extent of use of stringing 34, indicating when stringing 34 should be replaced or restrung.

Figures 2, 3:
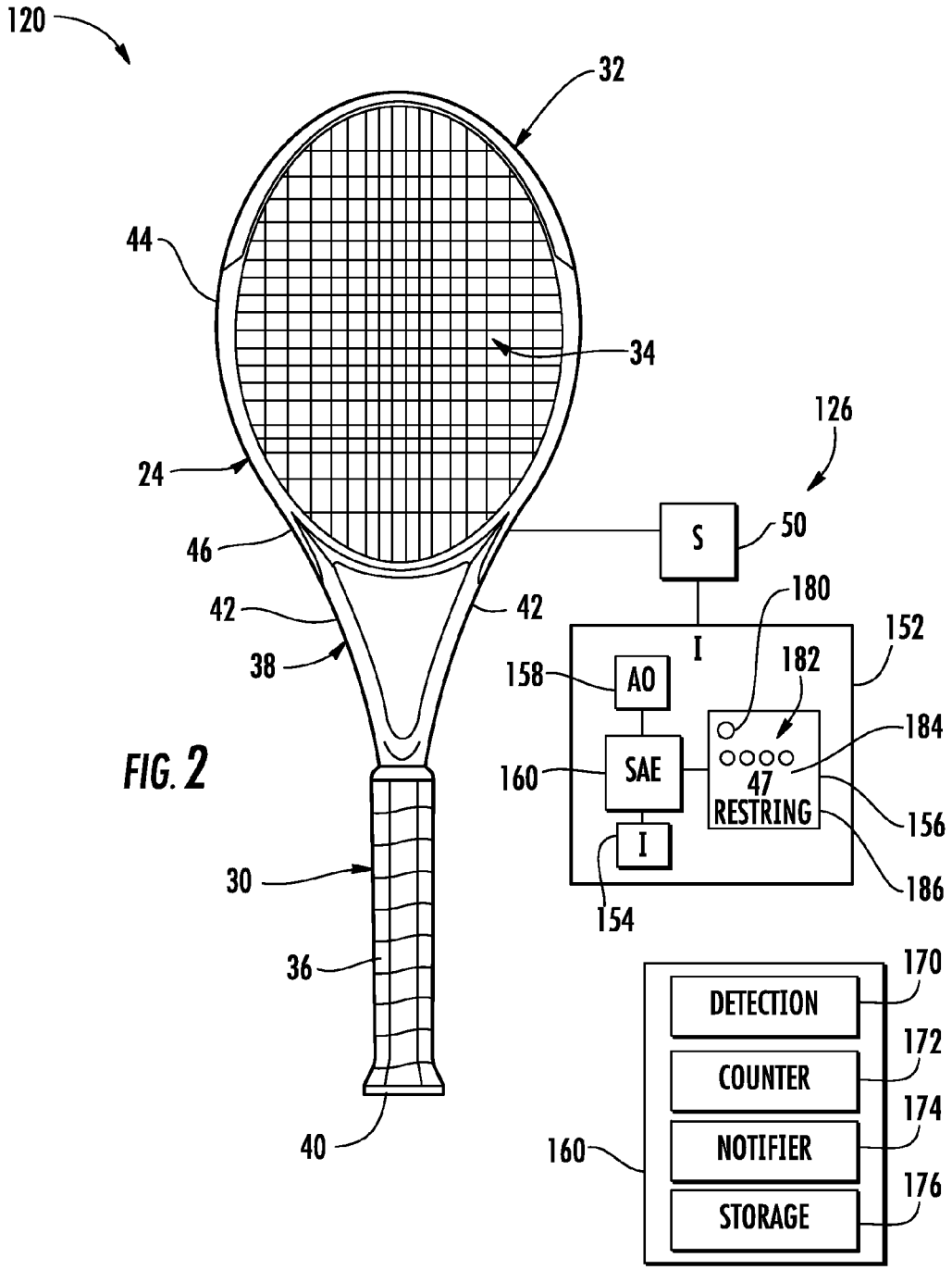
FIG. 2 is a schematic diagram of another example racquet system.
FIG. 3 is a schematic diagram of an example signal analyzing electronics.

FIG. 2 illustrates racquet system 120, a particular implementation of racquet system 20. Racquet system 120 is similar to racquet system 20 except that racquet system 120 is specifically illustrated as comprising hit notification system 126, a particular implementation of hit notification system 26. Those remaining components of racquet system 120 correspond to components of racquet system 20 are numbered similarly.

As with hit notification system 26, hit notification system 126 senses impacts of the ball or other projectile against stringing 34 of racquet 24 and outputs a notification based on the number of hits or impacts by the racquet. Hit notification system 126 comprises a sensor 50 (described above) and indicator 152, an example implementation of indicator 52. Indicator 152 is carried by racquet 24. In one implementation, indicator 152 is embedded or incorporated into or as part of racquet 24. In another implementation, indicator 152 is releasably fixed or mounted to racquet 24 in a fashion similar to the attachment of sensor 50 to racquet 24 as described above. In one implementation, indicator 152 can be embedded within the head portion 32, handle portion 30 or throat portion 38 and is visible only when an indication or message or signal is outputted.

Indicator 152 communicates with sensor 50 and outputs a notification based upon a number of hits or impacts between racquet 24 and a ball or projectile based upon signals from sensor 50. Indicator 152 comprises input 154, visual notification output 156, audible notification output 158 and signal analyzing electronics 160. Input 154 comprises one or more devices by which a person may enter data, make selections or enter commands for hit notification system 126. For example, in one implementation, input 154 may allow a person to select one of various modes by which a notification is presented, whether visual through visual notification output 156 or whether audible through audible notification output 158. Input 154 may allow a person to select one of various visual notification modes. In one implementation, input 154 may allow a person, such as a racquet stringer, to reset hit notification system 126 to a zero hit count value when stringing 34 is restrung or replaced.

In one implementation, input 154 may allow a person to enter customizable thresholds for when notifications are provided such as when restringing is suggested by notification system 126. For example, one person may prefer to be notified that restringing should be performed when performance is even slightly impacted by the lessening of tension of stringing 34. Another person may have greater tolerances for performance degradation, preferring to receive a notification for restringing at a later time when performance is even more impacted by the lessening of tension of stringing 34.

In one implementation, input 154 may further allow a person to input data or information regarding characteristics of racquet 24 such as characteristics of hoop 44 or characteristics of stringing 34. Examples of such characteristics include, but are not limited to, the initial tension of stringing 34, the manufacturer's recommended tension or range of tensions restringing 34, the gauge of stringing 34, the density of stringing 34, the material or type of stringing 34, the head size of the head portion 32, the material of hoop 44 and/or handle 36 and/or handle 36 of racquet 24. Such additional characteristics may be used by signal analyzer electronics 160 to more accurately identify hits or impacts to more accurately or reliably provide notifications based upon the identified number of hits or impacts.

In one implementation, input 154 may further allow a person to enter playing conditions, skill levels and/or racquet performance preferences. For example, input 154 may allow a person/player to enter his or her skill level. A player with a greater skill level may hit a ball or projectile with a greater force or velocity such that the tension of stringing 34 may decline at a greater rate as compared to a player with a lower level of skill who hits a ball or projectile at a lesser force or velocity. Further, a player with greater skill typically imparts more spin to the ball upon impact. Such top spin and/or backspin strokes or swings of the racquet can induce greater stress upon the stringing caused greater or increased degradation of the stringing or the string tension of the stringing over time. Input 154 may additionally or alternatively allow a person/player to enter his or her racquet performance preferences. For example, a first player may prefer lesser string tension while a second player may prefer greater string tension depending upon the player's preferences for ball control, spin, feel, responsiveness and other performance characteristics that depend upon the tension of stringing 34. Based on such inputs, signal analyzer electronics 160 may adjust its determination of when an impact occurs as well as when or how notifications are provided.

In one implementation, input 154 comprises a button, toggle switch, slider bar or other device by which data, instructions or commands may be manually entered. In yet another implementation, input 154 may comprise a microphone with associated speech recognition electronics built into racquet 24. In yet another implementation, input 154 may comprise an RFID reader, an optical scanner or other devices configured to sense or read an external RFID tag, bar code or the like indicating notification settings or preferences that are to be used by notification system 126. Overall, input 154 allows notification system 126 to be customized for a particular player's playing style, skill level and preferences as well as specific characteristics of the particular racquet 24 in which notification system 126 is employed. In yet other implementations, input 154 may be omitted, wherein such notification thresholds and settings are preprogrammed or otherwise pre-established for use by signal analyzing electronics 160 at the point of manufacture or attachment to racquet 24.

Visual notification output 156 comprises one or more devices by which notifications may be visually presented to a person/player. In one implementation, output 156 comprises a display screen such as in LED screen, organic light emitting diode screen or other screen technology. In another implementation, output 156 comprises a single light emitter, such as the light emitting diode, or a series or array of light emitters. Audio notification output 158 comprises a speaker or other device by which sound is generated to provide a notification from hit notification system 126. Although indicator 152 is illustrated as including both a visual notification output 156 and an audible notification output 158, some implementations, one of such notification outputs may be omitted. The visual notification output 156 can be positioned anywhere within or on the racquet 24.

Signal analyzing electronics 160 comprises electronics configured to receive signals from sensor 50, to determine or identify hits or impacts based upon such signals and to provide a notification based upon such determined hits or impacts using one or both of outputs 156, 158. For purposes of this disclosure, the term "electronics" means any combination of hardware, firmware, software/programming and the like facilitating the analysis of signals, identification of hits and provision of a notification based upon such hits. For example, in one implementation, signal analyzing electronics 160 may comprise one or more application-specific integrated circuits. In another implementation, signal analyzing electronics 160 may comprise one or more processing units and associated non-transient or non-transitory computer-readable mediums or persistent storage devices containing computer-readable instructions, programming or software code for directing the processing unit(s) to carry out the noted functions.

FIG. 3 schematically illustrates signal analyzing electronics 160 in more detail. As shown by FIG. 3, signal analyzer electronics 160 comprises several modules for carrying out different functions. Such modules may be implemented in different integrated circuits or different memory stored programming or code portions. In the example illustrated, signal analyzer electronics 160 comprises detection module 170, counter module 172 and notifier module 174. Detection module 170 utilizes signals from sensor 52 detector to identify impacts of a ball or projectile against stringing 34. In one implementation, detection module 170 may utilize one or more filters or threshold values to remove or discount signal noise for enhanced accuracy.

Counter module 172 receives signals from detection module 170 indicating a determined or deemed impact. Counter module 172 counts or tracks the number of impacts over time. When stringing 34 is replaced or restrung, counter 172 automatically or in response user input through input 154 is returned to a zero count value. In one implementation, counter module 172 comprises a digital counter. In another implementation, counter module 172 stores the current count value in memory or storage 176.

Notifier module 174 receives signals from counter 172 indicating a current count of the number of impacts and generates or otherwise produces control signals causing outputs 156, 158 to output a notification based on the number of hits by the racquet. In one implementation, notifier module 174 outputs such notifications based upon settings stored in storage 176. As described above with respect input 154, such settings may be based on various inputs such as characteristics of racquet 24, characteristics of the expected level or conditions of play of racquet 24 as well as player preferences.

FIGS. 2 and 3 illustrate four example modes for outputting a notification based on the number of hits by the racquet. In a first mode, notifier module 174 utilizes an individual light emitter 180 to provide a visible notification. Light emitter 180 may comprise a light emitting diode, a light tube, a lightbulb or other light emitting element. Light emitter 180 may comprise a portion of a display screen, such as a graphic presented on the display screen that is illuminated. Notifier module 174 adjusts one or more of an illumination color, an illumination brightness, and an illumination frequency based upon the current count for the number of hits upon stringing 34. For example, in one implementation, light emitter 180 may "turn on" and begin illuminating when the number of impacts or hits exceeds a predefined threshold such that restringing is recommended. As the need for restringing increases or as the number of hits exceeds subsequent greater thresholds, notifier module 174 may further adjust the frequency, brightness or color of light being illuminated by light emitter 180. For example, notifier module 174 may change the color from green to yellow to red as a number of hits pass certain thresholds. Notifier module 174 may additionally or alternatively increase the frequency of flashes of light emitter 180 as a number of hits pass certain thresholds. Notifier module 174 may additionally or alternatively increase a brightness of light being provided by light emitter 180 as a number of hits pass certain thresholds.

In a second mode, notifier module 174 utilizes an array or series 182 of individual light emitters to provide a visible notification. As with light emitter 180, a series 182 of individual light emitters may comprise individual light emitting diodes, individual light emitting balls or individual portions or graphics on a display screen. In this second mode, notifier module 174 selectively illuminates individual light emitters of the series 182 to indicate the number of hits or when restringing is suggested. For example, when a first threshold for the number of hits has been met, notifier module 174 may illuminate a first individual light emitter of the series 182. When a second threshold for the number of hits has been met, notifier module 174 may illuminate a second individual light emitter of the series 182. In one implementation, the first individual light emitter of the series previously lit continues to be lit while the second individual light emitter is illuminated. In another implementation, the illumination of the first individual light emitter is terminated when the second individual light emitter is illuminated. In the second mode, the number of light emitters that are illuminated indicates a number of hits or the number of thresholds have been met. In one implementation, notifier module 174 may additionally adjust one or more of the color, brightness and/or frequency at which the light emitters of the series 182 are illuminated to provide additional information. For example, different individual light emitters of the series 182 may be illuminated with different colors, different brightness or different frequencies. In one implementation, the first light emitter of series 182 may be green, the second light emitter of series 182 may be yellow of the third light emitter of series 182 may be red, wherein the red color indicates an urgent need for restringing.

In a third mode, notifier module 174 utilizes one or more alphanumeric characters or symbols to provide an actual hit count 184. The hit count may be provided on a display screen or with other display technologies. In one implementation, notifier module 174 may additionally adjust one or more of the color, brightness and/or frequency of the displayed hit count 184 to provide additional information. For example, the hit count 184 may be presented with different colors, different brightness or different frequencies. In one implementation, the hit count 184 may initially be green. After the hit count exceeds a first threshold indicating that stringing 34 may be restrung, the displayed hit count 184 may be changed to a yellow color. After the hit count exceeds a second greater threshold or strongly indicating that stringing 34 should be restrung, the displayed hit count 184 may be presented in a red color. Similar adjustments may be made additionally or alternatively employing brightness levels or flash frequencies. In other implementations, other colors or color combinations can be used.

In a fourth mode, notifier module 174 utilizes one or more alphanumeric characters or symbols to provide a restringing recommendation status 186. The restringing recommendation status may be provided on a display screen or with other display technologies. In one implementation, notifier module 174 may additionally adjust one or more of the color, brightness and/or frequency of the displayed restringing recommendation status 186 to provide additional information. For example, the restringing recommendation status 186 may be presented with different colors, different brightness or different frequencies. In one implementation, the restringing recommendation status 186 may be a displayed "OK" or other numerical character or text in green. After the hit count exceeds a first threshold indicating that stringing 34 may be restrung, the displayed status 186 may be changed to a "restring" message in a yellow color. After the hit count exceeds a second greater threshold or strongly indicating that stringing 34 should be restrung, the displayed status 186 of "restring" may be presented in a red color. Similar adjustments may be made additionally or alternatively employing brightness levels or flash frequencies. In one implementation, a person/player may select one of the example four notification modes. In one implementation, a person/player may select more than one of the four notification modes. In yet other implementations, hit notification system 126 may employ additional or alternative notification modes.

Although not illustrated, hit notification system 126 is powered by an internal battery. The internal battery may comprise an insertable or replaceable battery, such as a button cell battery. In one implementation, the internal battery is rechargeable through inductive recharging or through a plug-in port. In one implementation, the internal battery is rechargeable using one or more solar cells provided along an exterior of racquet 24. In another implementation, an energy harvesting module may be incorporated into racquet 24 and used to maintain or recharge the battery. In another implementation, the hit notification system 26 can be passive in nature and not require a separate battery, rechargeable battery or other remote power source. In one implementation, the notification system 26 can incorporate passive RFID technology.

Figure 4:
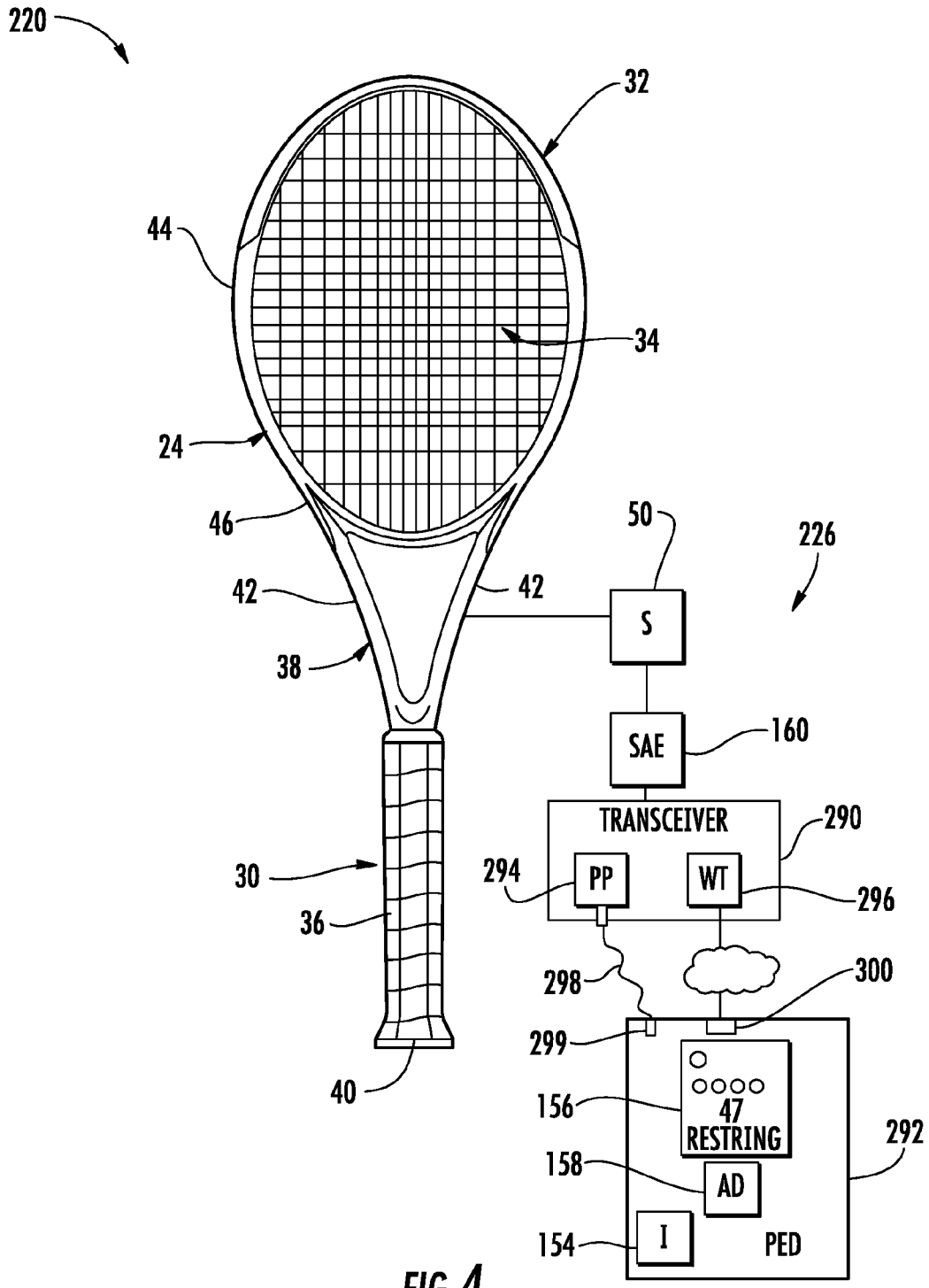
FIG. 4 is a schematic diagram of another example racquet system.

FIG. 4 illustrates racquet system 220, another example implementation of racquet system 20. Racquet system 220 is similar to racquet system 20 except that racquet system 220 comprises hit notification system 226 in place of hit notification system 26. Hit notification system 226 is itself similar to hit notification system 126 (shown and described with respect to FIG. 3) except that it notification system 226 additionally comprises transceiver 290 and portable electronic device 292.

Transceiver 290 comprises a device carried by racquet 24 that is configured to facilitate communication between signal analyzer electronics 160 (carried by racquet 24) and portable electronic device 292. In the example illustrated, transceiver 290 offers two modes of communication. Transceiver 290 comprises plug-in port 294 and wireless transceiver 296. Plug-in port 294 comprises a port by which a communication cable 298 extending between plug-in port 294 and portable electronic device 292 may be connected in a wired fashion. In one implementation, plug-in port 294 comprises a universal serial bus (USB) type port. In yet another implementation, plug-in port 294 may comprise other forms of communication ports by which data may be transmitted. In one implementation, power may be further provided through plug-in port 294 to recharge an internal battery of racquet 24.

Wireless transceiver 296 comprises a device by which data may be communicated in a wireless fashion between portable electronic device 292 and transceiver 290. In one implementation, wireless transceiver 296 comprises a Bluetooth device. In another implementation, wireless transceiver 296 comprises a Wi-Fi or other radiofrequency transmitter. In another implementation, wireless transceiver 296 comprises an active read/write RFID tag which is written upon with data sensed by sensor 28, wherein wireless transceiver 296 actively transmits signals from the tag. In another implementation, wireless transceiver 296 comprises an infrared or other optical communication device. In yet other implementations, wireless transceiver 296 may comprise other devices that communicate in a wireless fashion. In one implementation, transceiver 290 may omit one of plug-in port 294 and wireless transceiver 296.

Portable electronic device 292 comprises a device configured to receive signals output from transceiver 290 and to output a notification based upon the number of determined hits or impacts. In the example illustrated, portable electronic device 292 comprises input 154, visual notification output 156 and audible notification output 158 (as described above). Portable electronic device 292 is configured to communicate with transceiver either plug-in port 294 or wireless transceiver 296 through plug-in port 299 or wireless transceiver 300. Examples of portable electronic device 292 include, but are not limited to, a smart phone, a flash memory reader (IPOD), a cell phone, a personal data assistant, a laptop computer, a tablet computer, a netbook computer, a wrist-top computer and the like. In one implementation, portable electronic device 292 may be configured similar to or provided as part of a wristwatch, wristband or other wearable device, permitting a player or user to view notifications while on a court in real time. In yet another implementation, portable electronic device to 292 may be configured similar to or provided as part of a pair of glasses or other eyewear, permitting a player or user to view notifications while on the court in real time.

In operation, sensor 50 generates or produces electronic signals (or optical signals) in response to a ball or other projectiles impacting with stringing 34. Signal analyzer electronics 160 receive such signals and detection module 170 detects or determines impacts which are counted by counter module 172. The counted number of impacts are received by notifier module 174 which transmits data or control signals in a wired or wireless fashion to portable electronic device 292 where an appropriate notification (if warranted) is presented on portable electronic device 292 through either output 156 or output 158. Various settings for use by notifier module 174 or input through input 154 of portable electronic device 292 and are transmitted to signal analyzing electronics 160 in a wired or wireless fashion. In another implementation, notifier module 174 is alternatively incorporated as part of portable electronic device 292, wherein the counted number of impacts determined by counter module 172 are transmitted in a wired or wireless fashion to portable electronic device 292. In yet another implementation, counter module 172 and notifier module 174 are incorporated as part of portable electronic device 292, wherein detection module 170, incorporate part of racquet 24, detects impacts using signals from sensor 50 and communicates the detected impacts in a wired or wireless fashion to portable electronic device 292, where portable electronic device 292 counts and tracks such impacts and determines when and how a notification is presented using modules 172 and 174.

Figure 5:
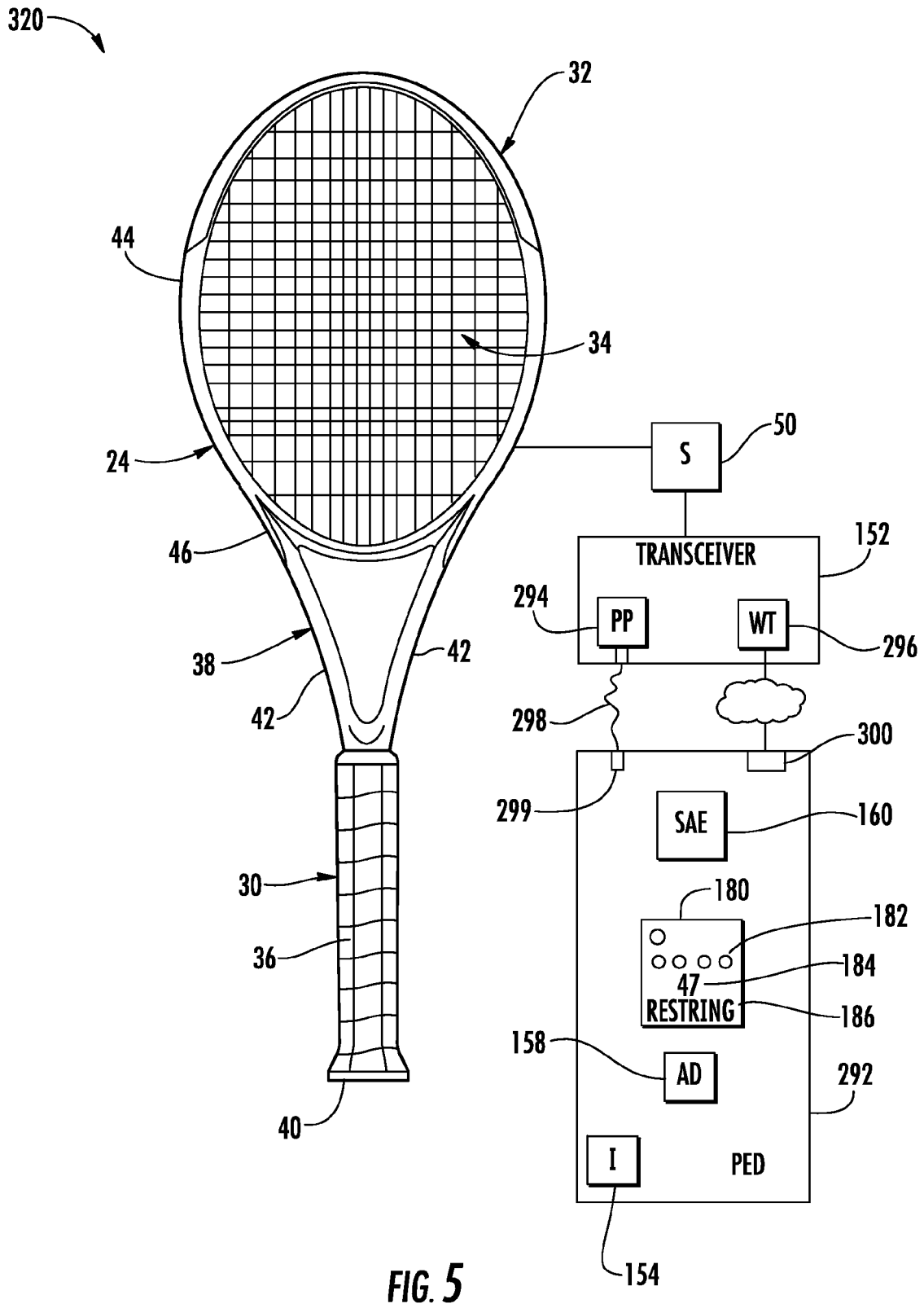
FIG. 5 is a schematic diagram of another example racquet system.

FIG. 5 illustrates racquet system 320, another example implementation of racquet system 20. Racquet system 320 is similar to racquet system 220 except that signal analyzing electronics 160 are entirely incorporated as part of portable electronic device 292. In racquet system 320, signals from sensor 50 presumably resulting from impacts with stringing 34, are directly sent to portable electronic device 292 by transceiver 152 in a wired or wireless fashion. Signal analyzer electronics 160 of portable electronic device 292 receive such signals and determine or identify impacts (using detection module 170), count the number of impacts (using counter module 172) and output a notification on output 156 and/or output 158 (using notifier module 174).

Figure 6:
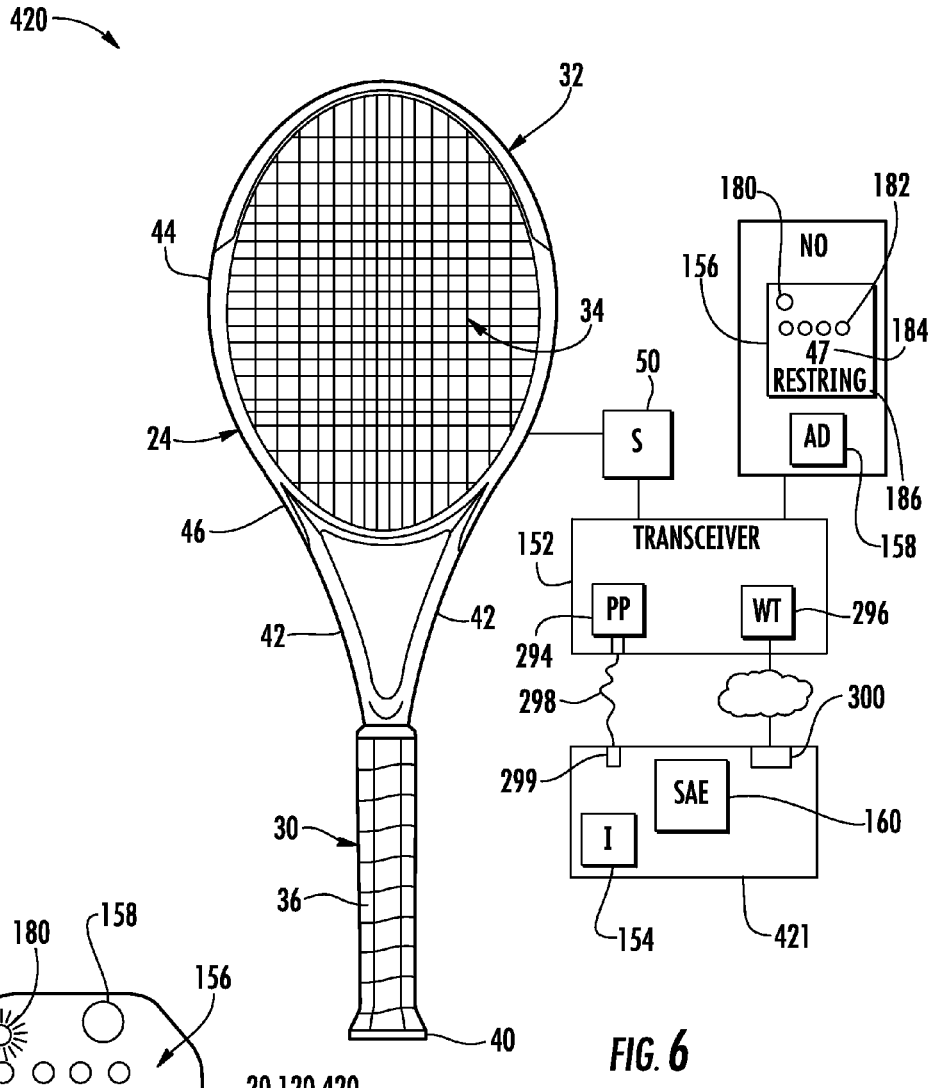
FIG. 6 is a schematic diagram of another example racquet system.

FIG. 6 illustrates racquet system 420, another example implementation of racquet system 20. Racquet system 420 is similar to racquet system 320 except that notification outputs 156, 158 are incorporated into and carried by racquet 24, wherein signal analyzing electronics 160 remain remote from racquet 24. In operation, sensor 50 generates or produces electronic signals (or optical signals) in response to a ball or other projectiles impacting with stringing 34. Signals from sensor 50 presumably resulting from impacts with stringing 34, are directly sent to a remote signal analyzer 421 by transceiver 152 in a wired or wireless fashion. Signal analyzer electronics 160, provided at the remote signal analyzer 421, receives such signals and determine or identify impacts (using detection module 170) and count the number of impacts (using counter module 172). The counted number of impacts are received by notifier module 174 which transmits data or control signals in a wired or wireless fashion to at least one of notification outputs 156, 158 where an appropriate notification (if warranted) is presented using either output 156 or output 158. Various settings for use by notifier module 174 are input through input 154 remote from racquet 24.

In one implementation, remote signal analyzer 421 comprises a portable electronic device similar to portable electronic device 292. In such an implementation, both the portable electronic device forming remote signal analyzer 421 and racquet 24 comprise at least one of outputs 156, 158, wherein notification may be provided on one or both of the portable electronic device and racquet 24. In another implementation, remote signal analyzer 421 comprises a computing device that is not readily portable, such as a desktop computer or a remote server computer. In one implementation, the remote server computer may additionally be configured to provide notifications based on the number of hits by the racquet based on signals from sensor 50 on a website. In such an implementation where such notifications are accessible on a website, racquet 24 may omit notification outputs 156 and/or 158. In yet other implementations, portions of signal analyzing electronics 160 may be incorporated into or provided as part of racquet 24 while other portions of signal analyzing electronics 160 are provided on a remote computing device or remote server. In yet other implementations, portable electronic device 292 of racquet systems 220, 320 may alternatively comprise a non-portable computing device, such as a remote computer server, wherein notification outputs 156, 158 are presented on a local area network or wide area network (Internet) webpage. For example, signal analysis and notifications may be carried out and provided in a cloud computing based environment.

Figure 7:
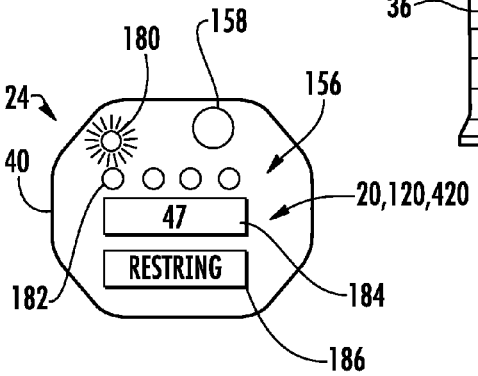
FIG. 7 is an end view of an example racquet including example notification outputs.

FIG. 7 illustrates one example implementation of notification outputs 156, 158. As shown by FIG. 7, in one implementation, visual notification output 156 and audible notification output 158 are located in the butt cap 40 of racquet 24. As a result, output 156, 158 do not detract from the in play use of racquet 24. At the same time, such notifications are readily discernible by a person/player. In such an implementation, signal analyzing electronics 160 (described above) may be incorporated into the interior of handle 36 where such electronic or less susceptible to shock and vibration and where adequate space exists for such electronics without altering the configuration of racquet 24.

In other implementations, the hit notification system 26, 126, 226, 320 and/or 420 can include additional sensors, an algorithm or other logic to incorporate one or more other variables or factors into the hit notification system. For example, the time elapsed since the last stringing can be incorporated into the logic for determining when the hit notification system indicates replacement is warranted. For example, if six months has elapsed since the last stringing of the racquet, the threshold or thresholds for providing notification of replacement may be adjusted lower by a predetermined amount, such as 90 percent of the original threshold value for hits. Other time frames and percentages can also be employed. In another implementation, string type, string diameter, string model, original string tension, and/or other string characteristic can be factored into the hit notification system and the threshold value can be maintained, increased or decreased depending upon one or more characteristics of a string. For example, if a particular string model is known to be highly durable and has a tendency to maintain its tension longer than other string models, the threshold value or values of the hit notification system can be increased slightly to adjust to the string model. In other implementations, other variables may also be incorporated into the analysis, such as user's swing speed.

Although the present disclosure has been described with reference to example embodiments, one skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. For example, the implementations discussed above can be used for monitoring other racquet characteristics, such as swing speed, racquet position, etc. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a racquet;

a sensor carried by the racquet; and an indicator in communication with the sensor to output a notification based on (a) the number of hits by the racquet based on signals from the sensor; and (b) at least one of an elapsed time since a last stringing of the racquet and an input skill level of a person using the racquet.

2. The apparatus of claim 1, wherein the indicator comprises:

sensor signal analyzing electronics carried by the racquet; and a notification output carried by the racquet to provide the notification.

3. The apparatus of claim 2, wherein the notification provided by the notification output is a visible notification comprises the visible notification comprises one of: an estimated number of hits by the racquet; a recommendation for restringing the racquet; and a combination thereof.

4. The apparatus of claim 3, wherein the visible notification is on a handle butt of the racquet.

5. The apparatus of claim 2, wherein the notification provided by the notification output is an audible notification.

6. The apparatus of claim 1, wherein the sensor comprises at least one of: an accelerometer; a vibro-acoustic sensor; a strain gauge; a load cell; and combinations thereof.

7. The apparatus of claim 1, wherein the indicator comprises a counter carried by the racquet and in communication with the sensor, and wherein the indicator further comprises a memory carried by the racquet to store a counted number of hits by the counter.

8. The apparatus of claim 1, wherein the indicator comprises:

sensor signal analyzing electronics carried by the racquet to produce data based on signals from the sensor; and a transmitter carried by the racquet to output the data to electronics remote from the racquet.

9. The apparatus of claim 8, wherein the transmitter comprises at least one of a wireless transmitter and a plug-in port.

10. The apparatus of claim 1, wherein the indicator further comprises a notification output remote from the racquet to output the notification based on the data.

11. The apparatus of claim 10 further comprising a portable electronic device comprising the notification output.

12. The apparatus of claim 11, wherein the notification output comprises a display of the portable electronic device.

13. The apparatus of claim 1, wherein the indicator comprises:

a transmitter carried by the racquet to output signals from the sensor; and a portable electronic device remote from the racquet, the portable electronic device comprising:

a transceiver to receive the signals from the transmitter;

signal analyzing electronics to analyze signals to produce data; and a notification output to output the notification based on the data.

14. The apparatus of claim 13, wherein the notification output comprises a display of the portable electronic device.

15. The apparatus of claim 1, wherein the indicator comprises:

a transmitter carried by the racquet;

a first notification output carried by the racquet;

a second notification output carried by a portable electronic device remote from the racquet; and operational mode electronics carried by the racquet, the operational mode electronics operable in one or more of the following user selectable modes: (1) a first mode in which the notification is output on the first notification output carried by the racquet; and (2) a second mode in which the notification is output on the second notification output of the portable electronic device.

16. The apparatus of claim 1 further comprising a user input and signal analyzer electronics that count the number of hits by the racquet, wherein the identification of a hit by the signal analyzer electronics varies depending upon at least one input provided using the user input, the at least one input selected from a group of inputs consisting of: an input of a player's skill level and an input string tension.

* * * * *